US008765245B2

(12) United States Patent
Llano

(10) Patent No.: US 8,765,245 B2
(45) Date of Patent: Jul. 1, 2014

(54) SELF ADHERING FABRIC PATCH

(75) Inventor: Mark Llano, Wellington, FL (US)

(73) Assignee: Source One Distributors, Inc., Wellington, FL (US)

( * ) Notice: Subject to any disclaimer, the term of this patent is extended or adjusted under 35 U.S.C. 154(b) by 850 days.

(21) Appl. No.: 12/074,623

(22) Filed: Mar. 4, 2008

(65) Prior Publication Data

US 2011/0168320 A1 Jul. 14, 2011

(51) Int. Cl.

| | |
|---|---|
| ***G09F 3/10*** | (2006.01) |
| ***C09J 7/02*** | (2006.01) |
| ***B32B 7/06*** | (2006.01) |
| ***B32B 7/12*** | (2006.01) |

(52) U.S. Cl.
USPC ..... 428/40.1; 428/343; 428/354; 428/355

(58) Field of Classification Search
USPC ..... 428/343, 40.1, 354, 355
See application file for complete search history.

(56) References Cited

U.S. PATENT DOCUMENTS

| | | | | |
|---|---|---|---|---|
| 1,765,098 | A | 6/1930 | Roozendaal | |
| 3,772,114 | A | 11/1973 | Kowalchuk | |
| 4,047,994 | A | 9/1977 | Komatsu | |
| 4,061,826 | A * | 12/1977 | Petras et al. | 428/356 |
| 4,086,113 | A | 4/1978 | Cataffo et al. | |
| 4,715,914 | A * | 12/1987 | Viner | 156/94 |
| 4,759,812 | A | 7/1988 | Miller | |
| 5,145,541 | A | 9/1992 | Baron et al. | |
| 5,771,496 | A | 6/1998 | Wood | |
| 5,916,391 | A | 6/1999 | Riedel et al. | |
| 5,958,526 | A * | 9/1999 | Spickelmire | 428/17 |
| 6,022,914 | A * | 2/2000 | Nowak et al. | 524/101 |
| 2001/0020537 | A1 * | 9/2001 | Ueno et al. | 174/68.1 |
| 2003/0044563 | A1 | 3/2003 | Kocinec et al. | |
| 2004/0096491 | A1 * | 5/2004 | Tateishi et al. | 424/449 |
| 2005/0136266 | A1 * | 6/2005 | Zhou et al. | 428/447 |
| 2005/0192392 | A1 * | 9/2005 | Kim et al. | 524/436 |
| 2005/0271862 | A1 * | 12/2005 | Lapierre | 428/195.1 |

OTHER PUBLICATIONS http://web.archive.org/web/20071231054401/http://www.al-luniforms.com/fabguid.htm (2007).*

* cited by examiner

*Primary Examiner* — Samir Shah
(74) *Attorney, Agent, or Firm* — Brian J. Colandreo; Pamela K. Soggu; Holland & Knight LLP

(57) ABSTRACT

A flame retardant patch for repairing a tear or hole in clothing or gear includes a flame resistant fabric and a pressure sensitive adhesive bonded to the fabric by hot melt lamination. The pressure sensitive adhesive contains halogenated flame retardant compounds. A release paper covers the pressure sensitive adhesive and is removed to allow application of the flame retardant patch to the clothing or other item being repaired. The patch is attached by applying pressure to the top fabric surface of the patch for approximately 45 seconds using the convex surface of a spoon-like object.

9 Claims, 2 Drawing Sheets

SELF ADHERING FABRIC PATCH

BACKGROUND OF THE INVENTION

1. Field of the Invention

The present invention is directed to a self-adhering fabric patch for repairing clothing, and more particularly, to a self-adhering flame retardant patch for quickly repairing tears or openings in clothing and gear such as, but not limited to, military combat uniforms, backpacks, camouflage helmet covers and other fabric articles, without the use of a hot iron or a thread and needle.

2. Discussion of the Related Art

Flame resistant materials are commonly used in the manufacture of military uniforms, and particularly combat uniforms, as well as firefighter gear, driving suits and gloves for race car drivers and astronaut suits. Obviously, use of flame resistant fabric materials for these various garments is for the purpose of protecting the wearer from burn injuries as a result of exposure to flames or extreme temperatures. The fire resistant material, typically made from aromatic polyamide fibers, provides a barrier of protection between the wearer's skin and flames from a fire or explosion. However, even a small hole or tear in the fire resistant fabric can compromise the burn protection property of the garment and expose the wearer to serious injury. In the event a direct flame finds its way through a hole or tear in the fire resistant garment, the wearer's undergarments can ignite and cause severe burns and possible fatal injury. Accordingly, it is important to repair all tears and openings in fire protective garments in a manner that completely closes these openings to restore the flame resistant integrity of the garment.

The repair of tears and openings is particularly problematic for soldiers wearing military combat uniforms. These soldier uniforms and various items of equipment (e.g. backpacks), usually made of a camouflage fabric such as NOMEX®, NYCO™, DEFENDER-M™, APECS Nylon outerwear, and ECWCS GORE-TEX®/CORDURA® gear are susceptible to tearing and seat and seam failures as a result of the harsh conditions a soldier is exposed to in combat and training operations. In the event a soldier wears a hole or gets a tear in the camouflage uniform or gear, it is extremely important to repair the opening as soon as possible. A tear in the uniform or gear could compromise the camouflage and render the soldier visible to the enemy. And, if the soldier's uniform is flame resistant (e.g. NOMEX®) it is important to close tears or openings in order to preserve the flame resistant integrity of the uniform. Due to the continuous threat of exposure to flames, such as from an improvised explosive device (IED), it is preferable to repair holes as tears in a soldier's uniform while out in the field. Presently, the only available method for soldiers to repair tears and openings in the flame resistant camouflage uniform is with the use of a needle and thread. However, this method of closing a tear or opening is not sufficient to provide full protection. Sewing an opening closed, particularly out in the field, does not restore the complete flame resistant integrity of the uniform. Accordingly, there remains an urgent need for a repair kit that allows a soldier to quickly and easily repair tears and openings in their uniforms and gear.

OBJECTS AND ADVANTAGES OF THE INVENTION

Considering the foregoing, it is a primary object of the present invention to provide a patch for repairing tears and openings in garments without the use of stitching, and wherein the repair patch includes a pressure sensitive adhesive that allows the patch to be fully bonded to the garment in approximately 45 seconds.

It is a further object of the present invention to provide a repair patch that includes a fabric layer that matches the garment being repaired, and further wherein the patch includes a pressure sensitive adhesive laminated to a bottom side of the fabric to enable easy application and attachment of the patch to a garment in order to fully cover a tear or opening in the garment.

It is still a further object of the present invention to provide a repair patch that is particularly suited for repairing tears and holes in soldier uniforms and equipment, and wherein the patch includes a fabric with a digitally printed camouflage pattern that matches the camouflage pattern of the soldier uniform and equipment, and further wherein the patch is flame retardant.

It is still a further object of the present invention to provide a soldier uniform repair patch that quickly and easily attaches to the soldier uniform by applying pressure, such as with the use of a spoon-like object, in approximately 45 seconds and without the use of a needle and thread.

It is still a further object of the present invention to provide a soldier uniform repair patch that meets or exceeds the flame retardant and near infra red (NIR) compliance standards of the soldier uniform material.

It is yet a further object of the present invention to provide a fabric patch for repairing tears and openings in garments, and particularly soldier uniforms and gear, and wherein the repair patch attaches by pressure sensitive adhesive and withstands at least 10 complete laundering cycles (i.e. washing and drying) with a maximum separation around the edges of the patch of ⅛ of an inch. These and other objects and advantages of the present invention are readily apparent with reference to the detailed description and drawings.

SUMMARY OF THE INVENTION

The present invention is directed to a flame retardant patch for repairing a tear or hole in clothing and gear includes a flame resistant fabric made from aromatic polyamide fibers, and a pressure sensitive adhesive bonded to the fabric by hot melt lamination. The pressure sensitive adhesive contains halogenated flame retardant compounds. A release paper covers the pressure sensitive adhesive and is removed to allow application of the patch to the clothing item being repaired. The patch is attached to clothing and gear by applying pressure to the top fabric surface of the patch, pressing firmly to smooth out wrinkles, creases and air pockets, and then rubbing with consistent pressure for approximately 45 seconds, using the convex surface of a spoon-like object, to push the adhesive into the pores of the fabric of the clothing or gear while generating heat to accelerate the adhesion process. In a preferred embodiment, the patch is used for repairing soldier combat uniforms and gear made of camouflage material such as NYCO Twills and Ripstop, Defender-M™, Nomex®, APECS Nylon outerwear, and ECWCS GORE-TEX®/CORDURA® gear. The flame resistant fabric of the patch is digitally printed with a camouflage pattern that matches the soldier uniform and/or gear camouflage pattern. The patch meets or exceeds the flame retardant and NIR compliance standards of soldier combat uniforms.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 5:
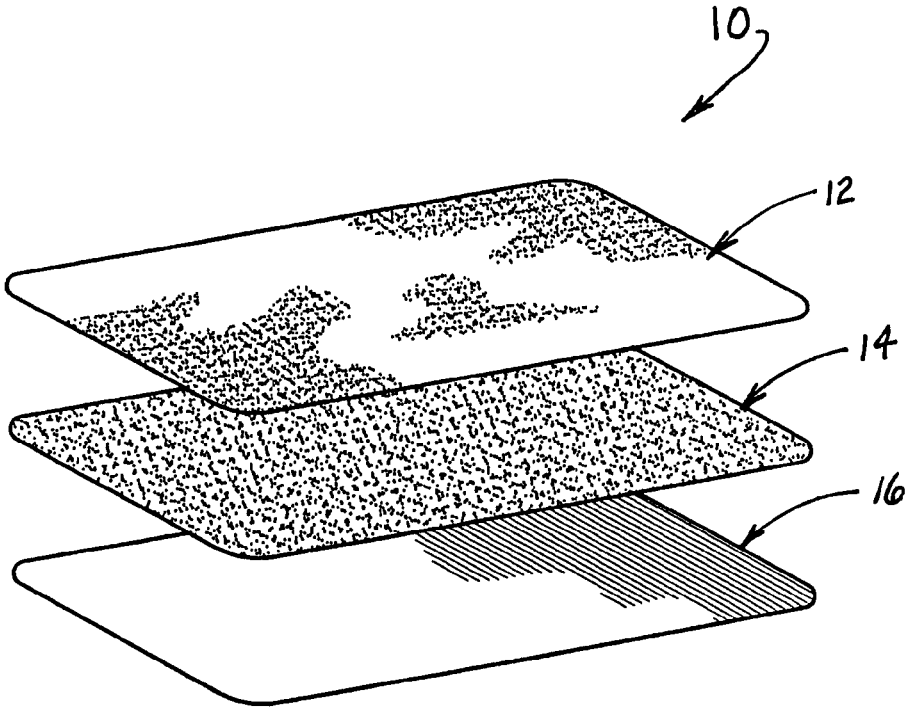
FIG. 5 is an exploded perspective view showing the structural layers of the repair patch of the present invention.

Referring initially to FIG. 5, a preferred embodiment of the repair patch of the present invention is shown and is generally indicated as 10. The repair patch includes a fabric layer 12, a pressure sensitive adhesive 14 that is laminated to the bottom side of the fabric layer 12 by hot melt lamination, and a paper release liner 16 (i.e., backing) for protectively covering the pressure sensitive adhesive prior to application. The patch 10 is die cut to the desired size and is preferably provided with radiused corners. It is contemplated that the patch will be provided in a range of sizes and is generally square or rectangular in shape, although other shapes (e.g., round) are contemplated as well. The patch is packaged, preferably in different sizes (e.g., a total of 8 patches) in a clear plastic bag/envelope with application instructions.

In a preferred embodiment, the top fabric layer 12 of the patch 10 is flame resistant and made with aromatic polyamide fibers. The repair patch of the present invention preferably uses NOMEX® IIIa fabric available from Southern Mills, Inc. of Union City, Ga. NOMEX® is a registered trademark of DuPont. The NOMEX® IIIa material is digitally printed with a camouflage pattern to match the camouflage pattern of the soldier uniform and meets or exceeds the flame retardant and NIR (near infra red) compliant standards of the soldier uniform material.

In a preferred embodiment, the pressure sensitive adhesive is SCAPA P1089™ available from Scapa North America of Windsor, Conn. SCAPA P1089™ is a flame retardant pressure sensitive adhesive that contains the following ingredients:

| | |
|---|---|
| 14%-18% | Acrylic Pressure Sensitive Adhesive |
| 1%-2% | Rosin |
| 22%-28% | Halogenated Flame Retardant Compounds |
| 37%-43% | Silicone Coated (2-sides), Polyethylene Coated (2-sides) paper |

Figure 1:
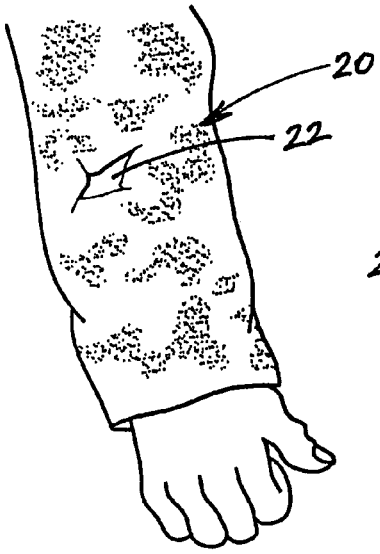
FIG. 1 is an isolated view of a sleeve of a camouflage uniform on the arm of a soldier, shown with a tear in the material of the uniform.
Figure 2:
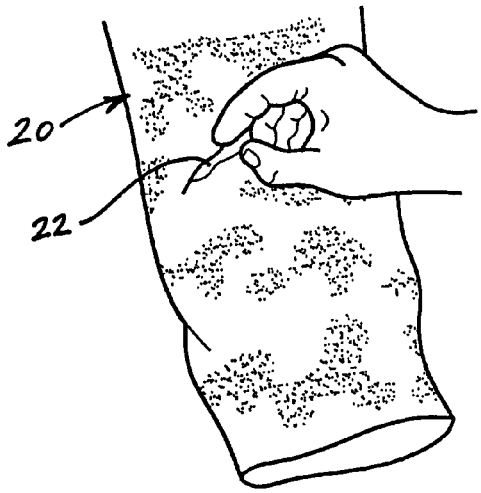
FIG. 2 is an isolated perspective view demonstrating the manner of repairing the tear shown in FIG. 1, by first closing the tear using the fingers.
Figure 3:
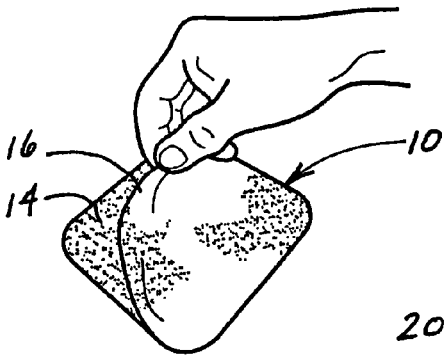
FIG. 3 is a perspective view showing the uniform repair patch of the present invention, and particularly a protective backing paper being peeled away from a pressure sensitive adhesive layer of the patch.
Figure 4:
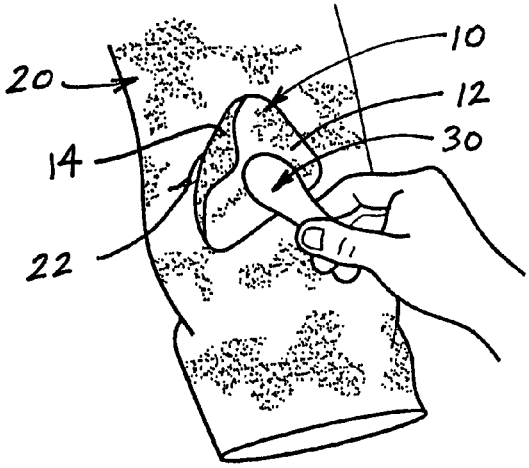
FIG. 4 is an isolated perspective view showing application of the repair patch to the sleeve of the soldier uniform by placing the pressure sensitive adhesive side of the patch over the area surrounding the tear and using the concave side of a spoon-like object to apply pressure to the outer surface of the patch, thereby causing the patch to adhere to the surface of the sleeve of the uniform while covering the tear.

FIGS. 1-4 demonstrate the manner of attachment of the patch 10 to a soldier uniform 20 having a tear 22 in the sleeve. As seen in FIG. 1, the tear creates a significant opening in the sleeve of the uniform that exposes the soldier to potential burn injury in the event of an explosion. FIG. 2 demonstrates the manner of repairing the tear by first lying the garment on a flat, rigid surface and bringing the torn edges of the fabric together, to thereby close the opening in the sleeve. Any excess frayed materials along the torn edges should be trimmed away. The area of application should be free of dirt, sand, oil and other debris. It is preferable that the garment be laundered first, before patch application. Next, in FIG. 3, the patch 10 is prepared for attachment by first removing the peel-away backing paper to expose the pressure sensitive adhesive. Next, as seen in FIG. 4, the patch is placed over the tear, while maintaining the torn edges pulled together, and with the pressure sensitive adhesive applied directly to the outer surface of the uniform material surrounding the tear. Once positioned over the tear, the patch is pressed firmly with the fingers to smooth out wrinkles, creases or air pockets to ensure full adhesion. A spoon-like object 30 is then rubbed on the outer fabric surface of the patch in a reciprocating motion across the entire surface of the patch while applying pressure. The reciprocating motion and pressure exerted by the concave surface of the spoon-like object 30 against the patch pushes the adhesive into the fabric of the garment and generates heat and pressure to cause the pressure sensitive adhesive to fully bond with the exterior fabric of the uniform. After approximately 45 seconds of rubbing with consistent pressure, the patch will be fully adhered to the uniform, covering and maintaining the tear closed.

In order to determine the longevity of the patch, through numerous laundering cycles, the following experiment was performed:

Wash Test

Scope

This experiment was designed to evaluate the behavior of the repair patch on soldier uniforms when subjected to washing conditions through repeated laundering cycles.

Preparation of Samples

ACU coat and pants made out of NYCO™ material were purchased from an Army surplus store. Three inch by three inch repair patches with rounded corners (one inch radius) were used. First, the release liner was removed from the patches in order to expose the pressure sensitive adhesive. Two patches were applied on the back of the coat and one patch was applied to the elbow on the sleeve. Additionally, two patches were applied to one leg of the pant near the knee area. During application of the patches, each patch was rubbed with the back of a spoon while applying pressure and friction for approximately 45 seconds as the temperature of the patch steadily increased. This action was performed on a wooden table top.

Procedure

1. Water temperature was measured at the source (hot water faucet) with a Taylor digital thermometer, recording a reading of 130 degrees F.

2. Both samples were placed in the washing machine (Whirlpool Cabrio AGI). Arm and Hammer liquid laundry detergent was used.

3. Five fluid ounces of laundry detergent was added. Wash cycle was started with the machine settings at normal, light soil level, and hot/cold wash and rinse temperature.

4. Once the water filling phase was completed, the cycle was paused and the water temperature read inside the washing machine, with an observed reading of 116 degrees F.

5. Once the washing program ended, the samples were removed and observed.

6. Following the observations, samples were deposited in a clothes dryer at medium heat and automatic time cycle.

7. The drying cycle stopped when the dryer automatically sensed the samples were dry.

8. At the end of the drying cycle, the samples were removed and allowed to cool for two minutes.

Observations

The samples were subjected to 10 (ten) complete laundry cycles (i.e., washing and drying), after which the repair patches showed negligible separation not exceeding in any case the maximum of ⅛ of an inch around the perimeter edges of the repair patches.

In one preferred embodiment, the patch 10 conforms to the following specifications:

Flame Retardant Performance:

The flame propagation of the patch when applied to the base substrate shall be equal to or less than that of the original substrate. The material shall be tested in accordance with ASTM D 6413.

Spectral Reflectance:

The spectral reflectance of the patch shall conform to the performance specification as stated in MIL-DTL-44436 for each pattern/style of patch: Universal Camouflage, Woodland, and Desert Patterns.

Pattern Execution:

The pattern of the finished Universal Camouflage pattern patch shall reproduce the standard sample with respect to design, color, and registration of the respective areas. The pattern of the patch shall match the pattern on the specified drawing for the Universal Camouflage, 2-1-1516, 2-1-2240, and 2-1-2519.

Shade Execution:

The shade of each individual color shall match the colors outlined in MIL-DTL-44436.

Matching:

The color of the webbing shall match the Universal camouflage ACU standard sample (Or Woodland/Desert as applicable) when viewed under filtered tungsten lamp which approximate artificial daylight having a correlated color temperature of 75000+/−200K, with illumination of 100+/−20 foot candles, and shall be a good match to the standard sample under incandescent lamplight at 2300+/−200 K.

Adherence to Substrate:

The patch must remain adhered to the base substrate, on all sides (both outer and inner patches) with less than a ⅛ inch of delamination from the base substrate on all 4 sides of the patch material.

Laundering:

The patch must remain adhered to the substrate as stated above after 10 home laundering washing cycles.

Physical Performance:

The finished patch material shall conform to all applicable physical testing performance requirements as stated in MIL-DTL-44436, to include abrasion, weight, colorfastness, lightfastness and cracking.

While the present invention has been shown and described in accordance with a preferred and practical embodiment thereof, it is recognized that departures from the instant disclosure are contemplated within the spirit and scope of the present invention, which is not to be limited, except as defined in the following claims as interpreted under the Doctrine of Equivalents.

What is claimed is:

1. A launderable fire retardant patch for repairing a tear or hole in an article of clothing, comprising:

a sheet of fabric that is aromatic polyamide fibers, said fabric sheet having a top side and a bottom side; and a launderable fire retardant pressure sensitive adhesive bonded to the bottom side of said fabric sheet, said pressure sensitive adhesive including one or more halogenated flame retardant compounds such that said one or more flame retardant compounds comprise in the range of 22% and 28% of the pressure sensitive adhesive;

an acrylic pressure sensitive adhesive in the range of 14% to 18% of the pressure sensitive adhesive;

a rosin in the range of 1% to 2% of the pressure sensitive adhesive; and a silicone coated, polyethylene coated paper in the range of 37% to 43% of the pressure sensitive adhesive wherein the paper is coated on both sides with the silicone and the polyethylene.

2. The patch as recited in claim 1 wherein the top side of said fabric sheet is colored to match the outer surface of the article of clothing.

3. The patch as recited in claim 1 wherein said fabric sheet is digitally printed with a color pattern appearing on the top side of said fabric sheet for matching a color pattern on the article of clothing.

4. The patch as recited in claim 1 wherein said fabric sheet is digitally printed with a camouflage pattern appearing on the top side of said fabric sheet for matching a camouflage pattern on the article of clothing.

5. The patch as recited in claim 1 wherein said fabric sheet provides a spectral reflectance conforming to the performance specifications as set forth in MIL-DTL-44436.

6. A launderable flame retardant patch for repairing a tear or hole in an article of clothing, comprising:

a sheet of fabric made of a flame resistant material, said fabric sheet having a top side and a bottom side; and a launderable flame retardant pressure sensitive adhesive bonded to the bottom side of said fabric sheet, said pressure sensitive adhesive including one or more halogenated flame retardant compounds such that said one or more flame retardant compounds comprise in the range of 22% and 28% of the pressure sensitive adhesive;

an acrylic pressure sensitive adhesive in the range of 14% to 18% of the pressure sensitive adhesive;

a rosin in the range of 1% to 2% of the pressure sensitive adhesive; and a silicone coated, polyethylene coated paper in the range of 37% to 43% of the pressure sensitive adhesive wherein the paper is coated on both sides with the silicone and the polyethylene.

7. The patch as recited in claim 6 wherein the top side of said fabric sheet is colored to match the outer surface of the article of clothing.

8. The patch as recited in claim 6 wherein said fabric sheet is digitally printed with a color pattern appearing on the top side of said fabric sheet for matching a color pattern on the article of clothing.

9. The patch as recited in claim 4 wherein said fabric sheet is digitally printed with a camouflage pattern appearing on the top side of said fabric sheet for matching a camouflage pattern on the article of clothing.

* * * * *